United States Patent [19]

Voelz

[11] 4,284,159

[45] Aug. 18, 1981

[54] MOBILE CRANE

[75] Inventor: Richard F. Voelz, Butler, Wis.

[73] Assignee: Renner Manufacturing, Milwaukee, Wis.

[21] Appl. No.: 33,739

[22] Filed: Apr. 26, 1979

[51] Int. Cl.[3] ..... D62D 5/06

[52] U.S. Cl. ..... 180/140

[58] Field of Search ..... 180/140, 236, 234, 23, 180/24

[56] References Cited

U.S. PATENT DOCUMENTS

| | | | |
|---|---|---|---|
| 3,087,564 | 4/1963 | Quayle | 180/140 |
| 3,556,241 | 1/1971 | Mitchell | 180/140 |
| 3,680,653 | 8/1972 | Murata et al. | 180/140 |

*Primary Examiner*—John A. Pekar

*Attorney, Agent, or Firm*—Fred Wiviott

[57] ABSTRACT

A straddle type mobile crane includes a steering system which allows two-wheel or four-wheel steering. A first steering cylinder is associated with each wheel for four-wheel operation and an additional cylinder is associated with each of a first pair of wheels for two-wheel steering. An interlock system has a first mode for four-wheel drive wherein each wheel is coupled to its associated first steering cylinder and a second mode wherein each wheel is uncoupled from each first cylinder and each of the first pair of wheels are coupled to one of the additional cylinders and the other pair of wheels are locked to the frame. A first control prevents operation of the interlock unless the wheels are in predetermined orientation and a second control maintains proper alignment of the wheels in all angular positions.

25 Claims, 9 Drawing Figures

MOBILE CRANE

BACKGROUND OF THE INVENTION

This invention relates to a mobile type gantry crane.

Straddle type gantry cranes are commonly employed for lifting and moving large bulky objects, such as shipping containers, structural members, modular building sections, heavy machinery and equipment and the like. Such devices are well known and generally include a pair of inverted U-shaped gantries comprising cross beams spanning vertical columns which are supported at their lower ends on wheels or truck assemblies. The two gantry assemblies are interconnected by spaced side members and may include hoists supported from the cross beams by means of a trolley. This permits the load to be elevated and traversed laterally.

Mobile type cranes must be sufficiently maneuverable for being positioned above the load prior to elevation and for transporting the load from one location to another. When operated in a shop or storage area, for example, the crane will normally move longitudinally up and down an aisle and in addition, laterally between aisles. This requires a relatively flexible steering assembly. In addition, because of the large weight involved, particularly when a load is being transported, improper wheel orientation can cause inordinate stresses.

SUMMARY OF THE INVENTION

It is an object of the invention to provide a new and improved steering system for a gantry type crane.

A further object of the invention is to provide a steering system for gantry type cranes capable of both two and four wheel steering.

Another object of the invention is to provide a steering system for gantry type cranes in which proper wheel orientation is maintained.

These and other objects and advantages of the present invention will become more apparent from the detailed description thereof taken with the accompanying drawings.

DETAILED DESCRIPTION OF THE PREFERRED EMBODIMENT

Figure 1:
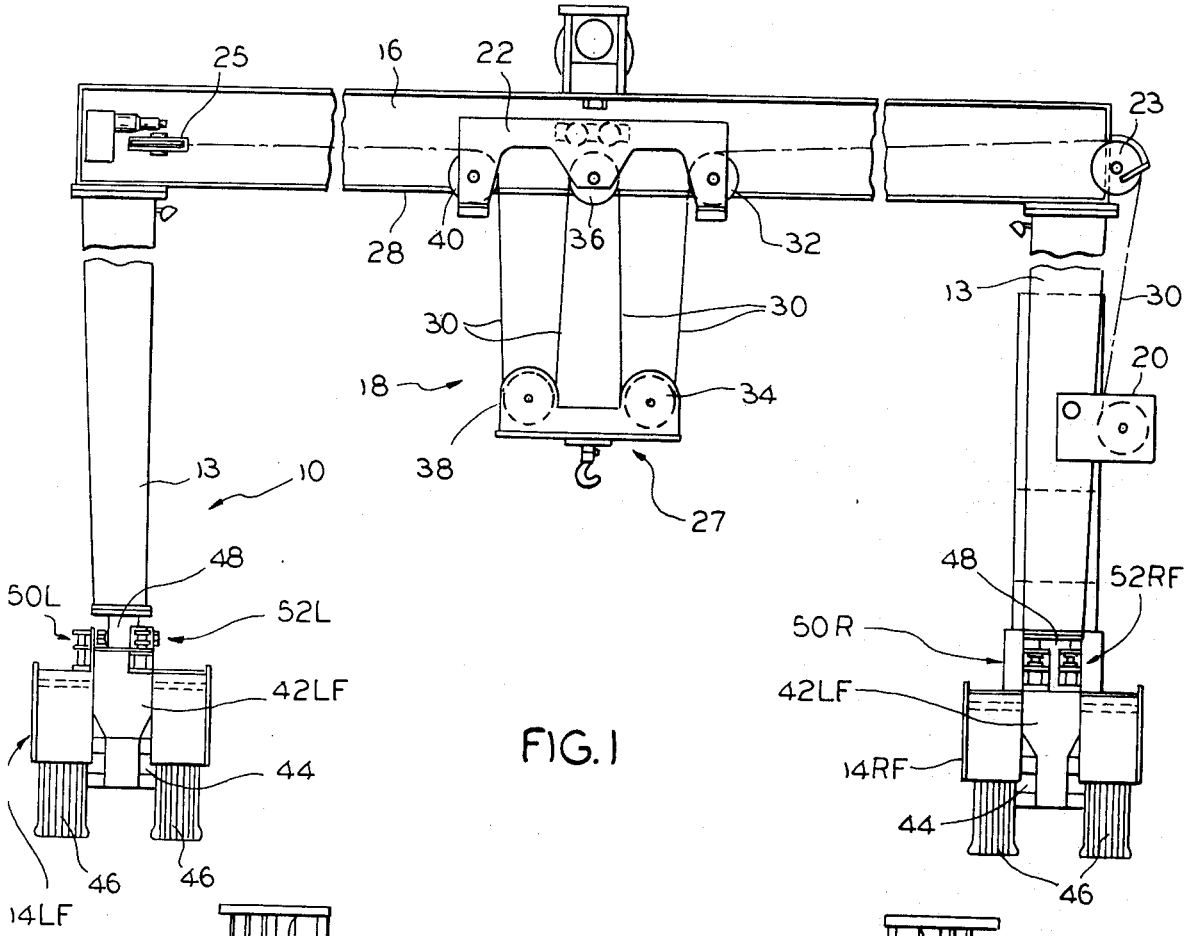
FIG. 1 is a front view of a gantry type crane which includes a steering mechanism according to the invention.
Figure 2:
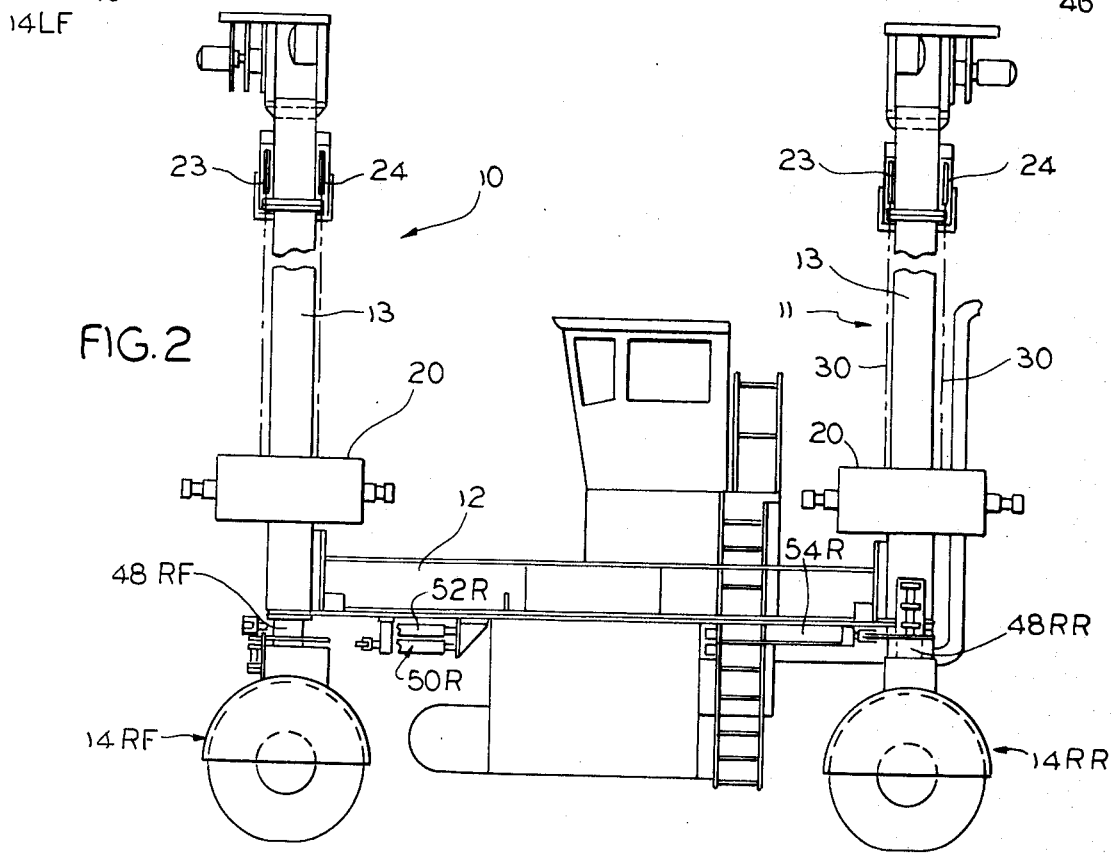
FIG. 2 is a side elevational view of the crane illustrated in FIG. 1.

Referring now to FIGS. 1 and 2, the gantry type mobile crane to which the present invention is applicable is shown to include a pair of U-shaped gantries 10 and 11 connected by spaced side girders 12. Each gantry includes a pair of vertical column members 13 supported at their lower ends by truck assemblies 14 and at their upper ends by horizontal cross members 16. For purposes of discussion, the reference numeral 14 will be used when discussing the trucks 14 collectively while the numerals and letters 14RF, 14LF, 14RR and 14LR will be used to specifically identify the trucks located at the right front, left front, right rear and left rear respectively of the assembly. Other portions of the assembly discussed below will similarly be identified depending upon whether the portions are discussed generally or specifically.

Each gantry 10 and 11 also includes a lifting assembly 18 which are identical and accordingly only one will be described for the sake of brevity. Each lifting assembly 18 includes a winch 20, a trolley 22, idler sheaves 23, 24 and 25 and a hook block 27. As those skilled in the art will appreciate, the trolley 22 includes wheels (not shown) which ride on the flanges 28 on each of the opposite sides of its associated cross beams 16. A wire rope 30 extends upwardly from each winch 20, over sheave 23, around a first sheave 32 on trolley 22, downwardly and around a first pulley 34 on hook block 27, upwardly and over a second sheave 36 on trolley 22, downwardly and around a second pulley 38 on block 27, upwardly and over a third sheave 40 on trolley 22, around sheave 25 at the opposite end of cross beam 16, backwardly along the opposite side of cross beam 16, around additional sheaves 40, 36 and 32 and pulleys 38 and 34 on the opposite sides of trolley 22 and block 27, around sheave 24 and back to the winch 20. Because the operation of the trolley 22 and hook block 27 form no part of the invention, they will not be discussed in detail. It will be sufficient for purposes of understanding the invention merely to state that the trolley may be moved longitudinally on the cross beams 16 and the hook block may be elevated for the purpose of positioning, lifting and replacing the load.

Each truck 14 includes a yoke 42 upon which an axle 44 rotatably supports a pair of wheels 46. The yokes 42 are pivotally mounted for movement about vertical axes by means of a vertically extending king pin 48 suitably received in a bearing (not shown) in the lower end of its associated column 13. Also mounted in each yoke 42 is a hydraulic drive motor (not shown) for rotating wheels 46 whereby the assembly may be moved from one location to another.

Each front truck assembly 14RF and 14LF is provided with a first steering assembly 50R and 50L, respectively, which are employed for two wheel steering and a second steering assembly 52R and 52L, respectively, which are employed during four wheel steering. In addition, each rear truck assembly 14RR and 14LR is respectively provided with a steering assembly 54R and 54L which is also employed during four wheel steering. It will be appreciated, therefore, that during two wheel steering, only the front trucks 14RF and 14LF will be turned while the rear trucks 14RR and 14LR will be locked in a position generally parallel to the side girders 12. During four wheel steering, however, all four trucks 14 will be coupled to its associated four wheel steering assembly 52 or 54.

Figure 3:
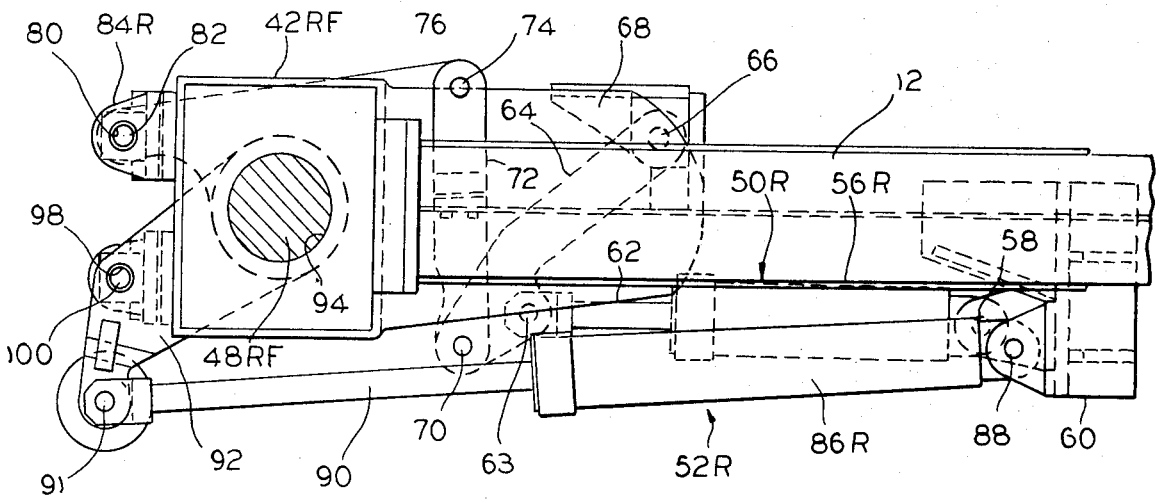
FIG. 3 is a top plan view of one portion of the steering assembly applied to a front wheel truck of the gantry crane of FIG. 1.
Figure 4:
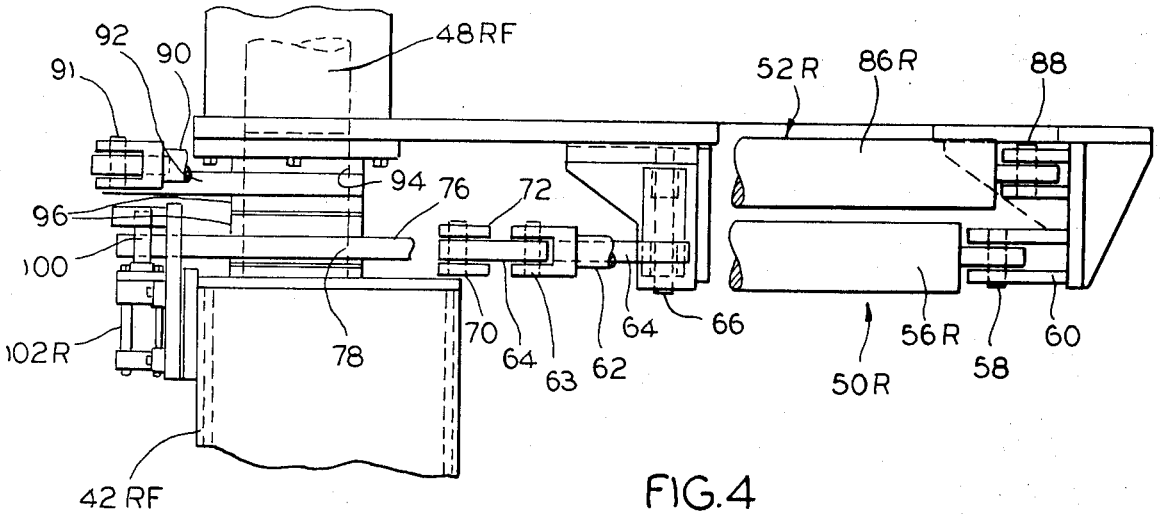
FIG. 4 is a front view of the steering assembly portion shown in FIG. 3.

The steering assemblies 50R and 52R for the truck 14RF are shown more particularly in FIGS. 3 and 4. Steering assembly 50R includes a first cylinder 56R pivotally mounted at one end by means of a vertically extending pin 58 and a bracket 60 affixed to the side of girder 12. A piston rod 62 extends from the other end of cylinder 56 and is pivotally connected at its end by means of a pin 63 to a bell crank 64 at a point intermediate its ends. One end of bell crank 64 is pivotally connected by means of a vertically extending pin 66 to a bracket 68 mounted on the other side of girder 12. The free end of bell crank 64 is pivotally connected by means of a pin 70 to one end of a link 72 which extends transversely below girder 12 where its opposite end is pivotally connected by pin 74 to one corner of a generally rectangular crank arm 76. An enlarged opening 78 (FIG. 4) is formed at a second corner of crank arm 76 for being received on the king pin 48RF for pivotal movement therearound. The other corner of arm 76 extends over the front of yoke 42RF and has a smaller aperture 80 for receiving a shot pin 82 which is movable into and out of opening 80 by means of a shot pin cylinder 84R (FIG. 3) mounted on the front surface of yoke 42.

FIG. 3 shows the steering assembly 50R in a neutral position wherein the wheels 46 are pointed forwardly and the piston rod 62 is in a midpoint position relative to cylinder 56R. When it is desired to turn the wheels in a counter-clockwise direction as viewed in FIG. 3, the piston rod 62 is forced outwardly of the cylinder 56R thereby rocking bell crank 64 clockwise and moving links 72 laterally toward crank arm 76. This pivots crank arm 76 counter-clockwise and also turns the yoke 42RF in the same direction as a result of the coupling therebetween by shot pin 82. Movement of the wheels in a clockwise direction is accomplished by moving piston rod 62 inwardly of cylinder 56R thereby rocking bell crank 64 counterclockwise to move the link 72 in a direction away from crank arm 76 so that crank arm 76 and yoke 42RF will turn in the clockwise direction.

The four wheel steering assembly 52R includes a second cylinder 86R pivotally connected by a pin 88 extending vertically through bracket 60 at a point slightly above and to the side of pin 58. Piston rod 90 extending from cylinder 86 is pivotally connected by means of a pin 91 to the end of a crank arm 92. The other end of arm 92 has an enlarged aperture 94 which is coradial with king pin 48RF and is pivotally received thereon at a location above crank arm 76 and spaced therefrom by a spacer 96. Arm 92 extends in a generally forward direction from king pin 48RF and has an aperture 98 formed intermediate its ends for receiving a shot pin 100 which is movable into and out of aperture 98 by means of a shot pin cylinder 102R mounted on the front of the fork 42RF and generally adjacent shot pin cylinder 84R.

When it is desired to effect four wheel steering, the shot pin 82 is moved out of aperture 80 so that crank arm 76 is uncoupled from yoke 42RF and shot pin 100 is moved into aperture 98 to couple arm 92 to yoke 42RF. Piston rod 90 is in an extended position relative to piston 86R when the wheels 46 are oriented in a forward direction. As a result, movement of piston rod 90 into cylinder 86 will pivot arm 92 and yoke 42RF counterclockwise as viewed in FIG. 3 through an angle of up to about 95°. Return movement of piston rod 90 out of cylinder 86 will, of course, move yoke 42RF in the counterclockwise direction until the wheels 46 are reoriented in their forward direction.

Figure 5:
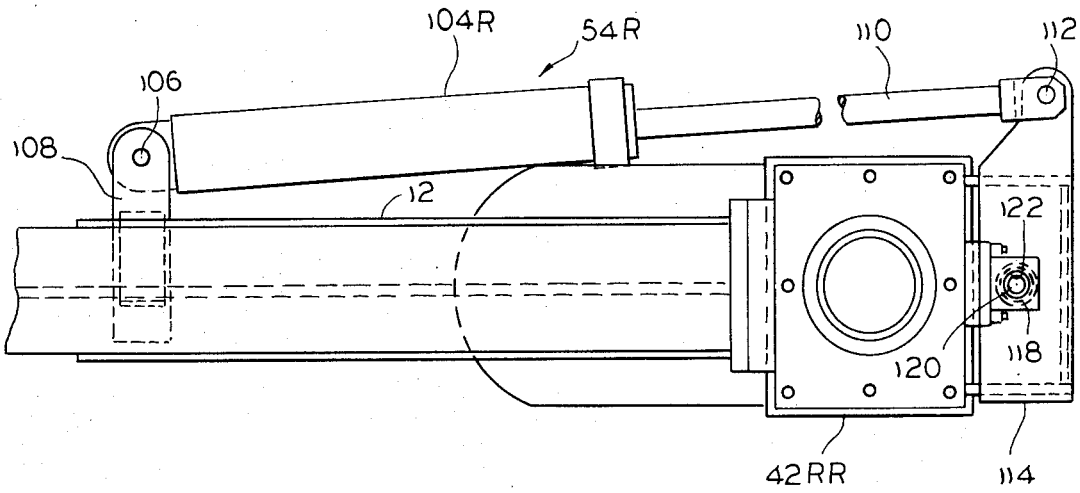
FIG. 5 is a bottom view of the second portion of the steering assembly as applied to one of the rear trucks of the gantry of FIG. 1.

FIG. 5 shows the third steering assembly 54R from below as applied to the right side of the assembly. The assembly 54R includes a cylinder 104R pivotally mounted at one end by a vertically extending pin 106 through a bracket 108 affixed to the right side girder 12. Extending from cylinder 104 is a piston rod 110 whose distal end is pivotally coupled by pin 112 to the end of an arm 114 connected to and extending laterally from the rear of yoke 42RR. Disposed above the arm 114 and affixed to the column 13 is a shot pin cylinder 118R operative to move a shot pin 120 into and out of an aperture 122 in arm 114.

When the gantry is to be operated in the two wheel mode, the shot pin 120 is disposed within aperture 122 to lock yoke 42RR to column 13 with the wheels 46 pointed forwardly. For four wheel operation, the shot pin 120 is withdrawn so that the cylinder 104R can pivot the yoke 42RR. As was the case with cylinder 86R, the cylinder rod 110 is in its fully extended position when the yoke 42RR is directed forwardly. Therefore, the yoke 42RR can only be pivoted between its position shown in FIG. 5 and a second position about 95° in the counterclockwise direction.

Figure 6:
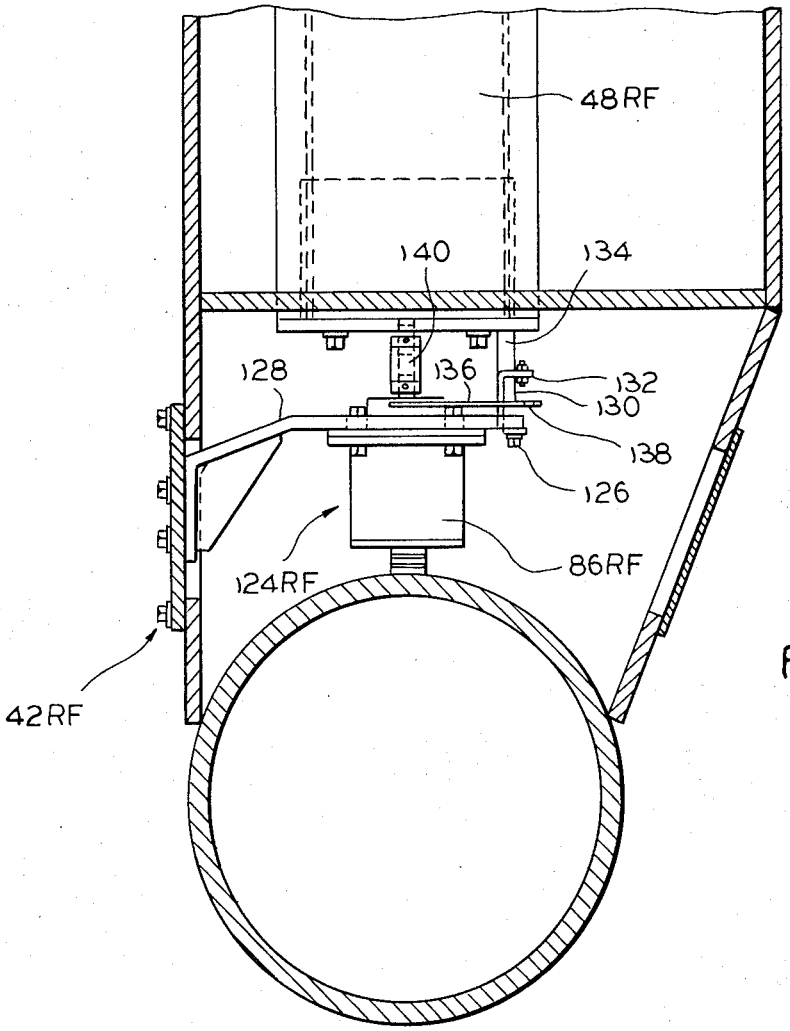
FIG. 6 is a side view with parts broken away of a portion of the wheel orientation control of the present invention.

It will be appreciated that the front forks 42RF and 42LF and the rear forks 42RL and 42RR must be in a proper alignment in order to move the shot pins 82, 100 and 120 into their respective openings 80, 98 and 122. Toward this end, a position control assembly 124 is provided at each fork. One such assembly 124RF in association with a front fork 42RF is shown in FIG. 6. Specifically, the assembly 124RF includes a photocell 126 supported on a bracket 128 which is in turn affixed to the yoke 42RF for pivotal movement therewith about the axis of king pin 48RF. Extending upwardly from bracket 128 is a generally L-Shaped support 130 for positioning a light source 132 above and in alignment with photocell 126. In addition, an arcuate shield 136 is supported from the base of column 13 by bracket 134 between photocell 126 and light source 132. The center of curvature of shield 136 lies along the axis of king pin 48RF and the radii of curvature of its inner and outer edges straddle the photocell 126 and light source 132. In addition, the arcuate extent of shield 136 is greater than the turning angle of the yoke 42RF. Accordingly, the shield 136 will be fixed relative to the photocell 126 and light source 132 and will at all times be disposed therebetween. However, shield 136 does have a small aperture 138 formed therein and positioned to lie in registry with photocell 126 and light source 132 when the wheels 46 are oriented forwardly and the shot pins 82 and 100 are in registry with their respective apertures 80 and 98. As will be discussed in greater detail below, the photocell 126 is coupled to the activating system for the shot pin cylinders 84 and 102 so that their operation is prevented except when yoke 42F is in a proper angular position. While the preferred embodiment is illustrated in connection with photo-switches, conventional limit switches may also be employed to indicate angular alignment.

The position control assembly 124 also includes a potentiometer 138RF supported by bracket 128 along the axis of fork 42RF. The wiper 140RF of potentiometer 138RF is affixed to column 13 and remains stationary as potentiometer 138RF rotates along the axis of fork 42RF. As a result, the voltage across potentiometer 138RF will vary with the angular position of fork 42RF to provide an angle position indication for purposes which will be disclosed below.

While the steering assemblers 50R, 52R and 54R have been discussed with respect to one side of the assembly, it will be appreciated that there are identical steering assemblies at the apposite side which are mirror images of those described. It will be appreciated that a position control assembly identical to 124RF will be provided at each fork so that operation of the associated shot pin cylinders can occur only when the forks are in proper alignment and further so that an electrical indication will be provided with respect to the angular position of each fork. When specific reference is made to those portions of the apparatus which have not heretofore been described but which are located at other locations of the apparatus, corresponding parts will be given the same numerals as those described above but they will be distinguished by the letters R, L, RF, LF, RR or LR depending respectively whether the assembly is disposed at the right, left, right front, left front, right rear or left rear portions of the apparatus. On the other hand when like parts of these assemblies at different locations of the apparatus are referred to collectively, only the reference numeral will be used without the letter designations.

Figures 7, 8:
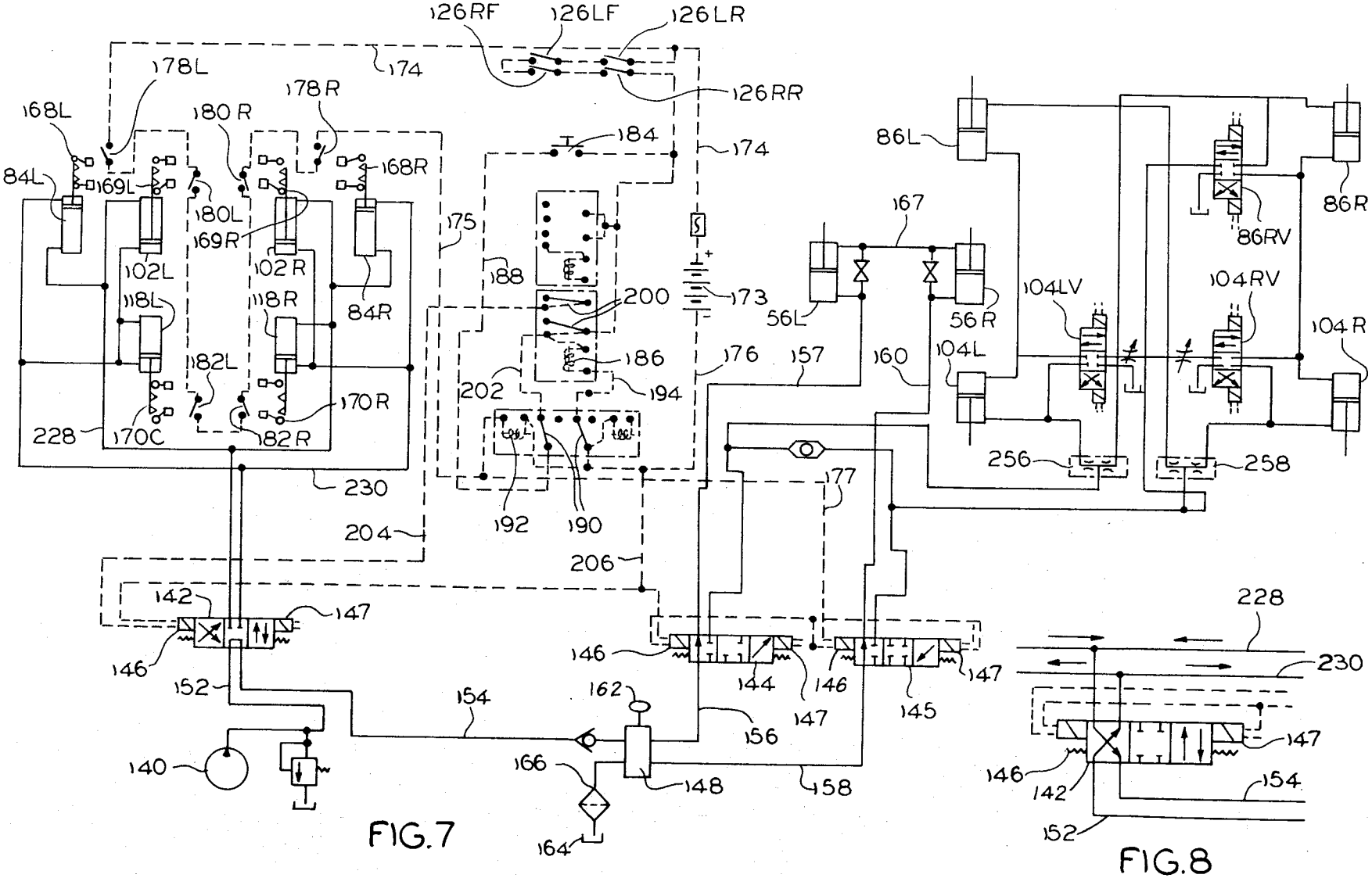
FIG. 7 schematically illustrates the electorial and hydraulic circuits of the steering assembly applied to the crane of FIG. 1.
FIG. 8 shows a portion of the hydraulic circuit of FIG. 7 in an alternate position.

Reference is now made to FIG. 7 which schematically illustrates a portion of the hydraulic and electrical circuits for selectively coupling the various steering and shot pin cylinders to a pump 140. Specifically, a first valve 142 is operable to selectively couple pump 140 to the shot pin cylinders 84, 102 or 118 for switching between four-wheel and two-wheel steering. Additionally, second and third valves 144 and 145 are operative to selectively couple steering cylinders 56, 86 and 104 at each side of the assembly, respectively, to pump 140. The valves 142, 144 and 145 are four-way, spring centered, directional valves each operable by solenoids 146 and 147.

FIG. 7 shows the system in the two-wheel steering mode wherein the solenoids 146 of valves 144 and 145 are energized and solenoid 146 of valve 142 is de-energized. Those portions of the circuitry not necessary for understanding of the operation of the apparatus in this mode have been omitted but can be seen in FIG. 9. When in this mode, valve 142 is in a neutral position so that pump 140 is connected through valve 142 to an orbital steering valve 148 through conduits 152 and 154. Also, valve 144 connects two-wheel steering cylinder 56L to the steering valve 148 through conduits 156 and 157 and valve 145 connects two-wheel steering cylinder 56R to valve 148 through conduits 158 and 160. Steering valve 148 may be manipulated by an operator when turning a steering wheel 162 to selectively connect valves 144 and 145 to the pump 140 or to a sump 164 through conduit 166. In addition, the opposite ends of cylinders 56L and 56R are connected by a conduit 167 so that the cylinders will move in opposite directions and through the same displacement, depending upon the positions of the steering valve 148 as set by the operator.

Respectively associated with each of the shot pin cylinders 84, 102 and 118 are first limit switches 168, 169 and 170. The first limit switches in turn control contacts which are in the energizing circuits of the solenoids 146 of valves 144 and 145. Specifically, solenoids 146 of the valves 144 and 145 are coupled to a battery 173 by a circuit consisting of conductors 174, 175, 176, 177, 206 and the closed contacts 178, 180 and 182 of limit switches 168, 169 and 170. It can be seen, therefore, that in order for solenoids 146 of valves 144 and 145 to remain energized and thereby couple steering cylinders 56 to pump 140, each of the contacts 178, 180 and 182 must be closed. This condition will prevail as long as shot pin cylinders 84 and 118 are in their fully extended positions and shot pin cylinders 102 are in their fully retracted positions. This insures that hydraulic fluid under pressure will not be delivered to steering cylinders 56 for two-wheel steering unless the shot pin cylinders 84, 102 and 118 are in the correct position for the two-wheel steering mode.

In order to switch the system from the two-wheel to the four wheel steering mode, the wheels must first be brought to the zero deflection position. This will close each of the photo switches 126 as discussed with respect to FIG. 6. A manual switch 184 may then be closed so as to energize a relay 186 through conductor 174, contacts 126, conductor 188, contacts 190 of relay 192, conductor 194, and conductor 176. As a result, the contacts 200 of relay 186 are stepped from their positions by full lines to that shown by broken lines. This completes an energizing circuit between the battery 173 and the solenoid 146 of valve 142 through a path defined by conductor 174, the photo switches 126, conductor 188, contacts 190, conductor 202, contacts 200, and conductors 204, 206 and 176.

When solenoid 146 of valve 142 is energized, it steps to its condition shown in FIG. 8 wherein conduit 152 is coupled to conduit 230 which in turn is connected to the upper ends of shot pin cylinders 84 and to the lower ends of shot pin cylinders 102 and 118. In addition, valve 142 couples conduit 154 to a second conduit 228 which is also connected to the opposite ends of each of these shot pin cylinders. Steering valve 148 also connects conduit 154 to sump 64. As a result, shot pin cylinders 84 are moved downwardly and shot pin cylinders 102 and 118 are moved upwardly as shown in FIG. 7 so that each of the first limit switch contacts 178, 180 and 182 are open to de-energize solenoids 146 of valves 144 and 145 so that conduits 156 and 158 are disconnected from conduits 157 and 160. In this manner the two-wheel steering cylinders 56 are disconnected from the pump 140.

It will be recalled that retraction of the shot pin cylinders 84 will uncouple the two-wheel steering cylinders 56 from their respective front forks. In addition, outward extension of the shot pin cylinders 102 will couple the front four-wheel steering cylinders 86 to the front forks and retraction of the shot pin cylinders 118 will uncouple the rear forks from the columns 13 to permit four-wheel steering of the rear forks.

Figure 9:
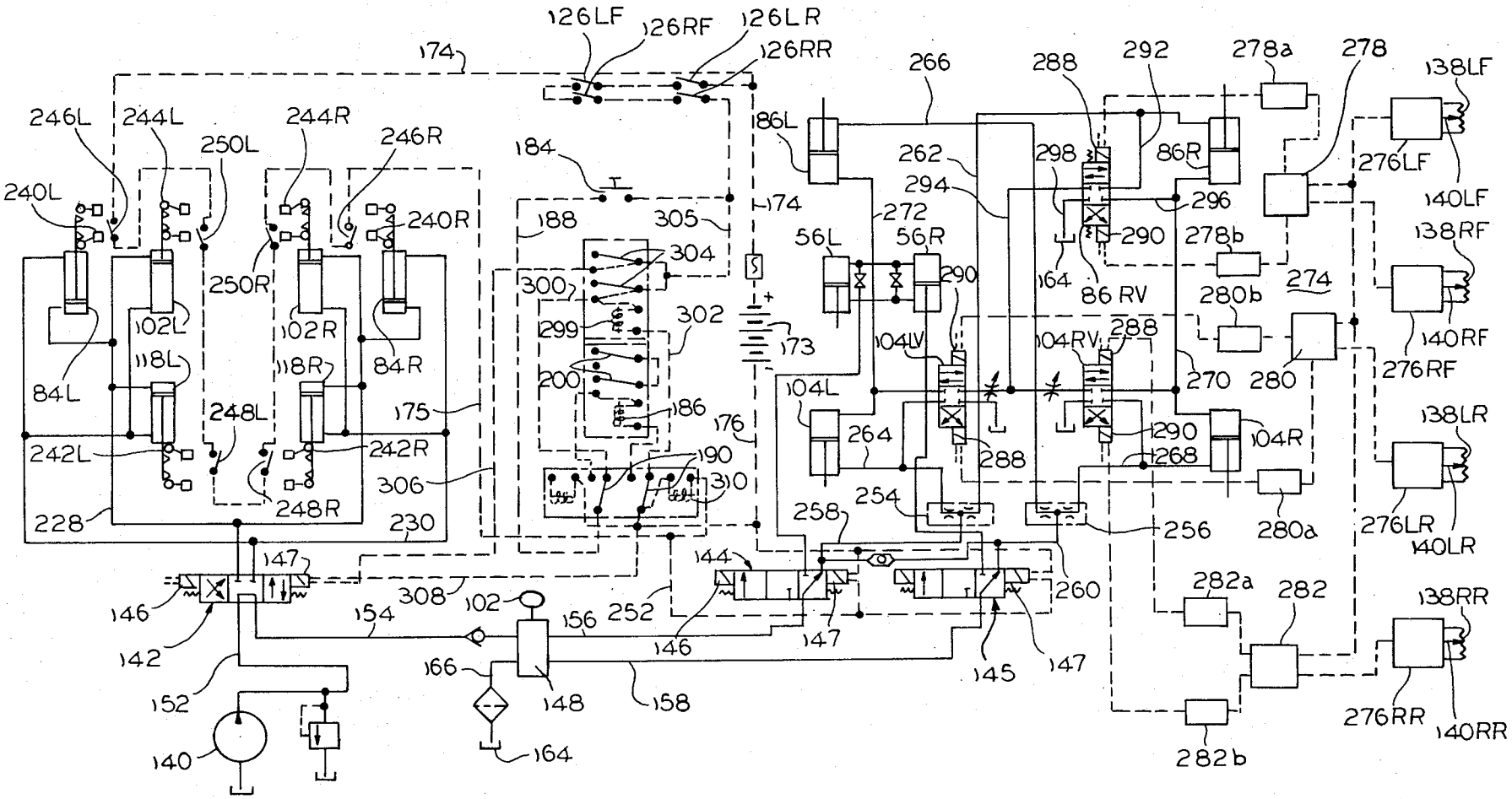
FIG. 9 shows the electrical and hydraulic circuitry of FIG. 7 in an alternate operating mode.

When each of the shot pin cylinders 84 and 118 reach their fully retracted positions and shot pin cylinders 102 their fully extended positions, as shown in FIG. 9, they will respectively engage a second one of their associated limit switches 240, 242 and 244, respectively. It should be noted that limit switch contacts 178, 180 and 182 are not shown in FIG. 9 because they are inactive during the four-wheel mode of operation, but they are of course, present in the apparatus. Operation of these limit switches will close their associated second limit switch contacts 246, 248 and 250 thereby completing an energizing circuit for battery 173 to each of the solenoids 147 of valves 144 and 145 through a circuit defined by said contacts and conductors 174, 175, 252 and 176. The operation of the solenoids 147 places the valves 144 and 145 in the condition shown in FIG. 9 wherein conduits 156 and 158 are respectively connected to flow dividers 254 and 256 by conduits 258 and 260. The first flow divider 254 is connected to one end of steering cylinder 86R by conduit 262 and to one end of steering cylinder 104L by conduit 264. Similarly, flow divider 256 is connected to one end of steering cylinder 86L by conduit 266 and to one end of steering cylinder 104R by conduit 268. The opposite ends of steering cylinders 86R and 104R are interconnected by conduit 270 and the opposite ends of steering cylinders 86L and 104L are interconnected by conduit 272. The closing of the limit switch contacts 246, 248 and 250 also completes an energizing circuit to the relay coil 192 to step the relay contacts 190 from their position shown in FIG. 7 to their position in FIG. 9. This de-energizes relay 186 which returns contacts 200 to their position in FIG. 9 whereby solenoid 146 of valve 142 is de-energized whereby the valve returns to its neutral position.

As indicated above, the steering valve 148 may be manipulated by an operator when turning the steering wheel 162 to selectively connect valves 144 and 145 to pump 140 or sump 164. Because equal amounts of hydraulic fluid will thus be delivered to each cylinder by the action of flow dividers 254 and 256, in the ideal case, each wheel is turned in the same direction and through the same angle. However, unavoidable variables such as valve and cylinder leakage, flow divider efficiency and slight linkage misalignment may cause slight differences in the hydraulic fluid delivered to each of the cylinders or slight variations in the turning angle as a result of mechanical differences. A servo system 274 has, therefore, been provided to equalize the turning angle of all wheels. The system 274 includes four potentiometers which 138RF, 138LF, 138RR and 138LR are mounted respectively in the yokes 42RF, 42LF, 42RR and 42LR. It will be recalled with reference to FIG. 6 that each of the potentiometers 138 are supported on their respective forks and that each of the wipers 140 are mounted on the adjacent column. Accordingly, if a potential was applied across each of the potentiometers, the voltage at the wiper will provide a measure of the deflection of each yoke. This relationship is employed to provide error signals which indicate the deviation, if any, in the deflection angle of the right front and two rear yokes with respect to the left front yoke by comparing the voltage at each of the potentiometer wipers 140RF, 140LR and 140RR with that at 140LF. Toward this end, a single conditioning and error amplifying signal 276 is associated with each potentiometer for receiving the wiper potential.

The servo circuit 274 also includes three voltage comparator circuits 278, 280 and 282. The voltage output signal from the circuit 276LF associated with the left front fork is provided as one input to each of the voltage comparator circuits 278, 280 and 282. The second input for each of the voltage comparator circuits 278, 280 and 282 are respectively the voltage output signals from the circuits 278LF, 276LR and 276RR. Accordingly, comparator circuit 278 compares the voltage representing the deflection of the right front fork 42RF as provided by circuit 276RF and the deflection of the left front fork 42LF as provided by the circuit 276LF. Similar comparisons are made by the circuits 280 and 282 of the deflections of the left rear and right rear forks to the right front fork. Coupled to voltage comparator circuit 278 is a first driver circuit **278*a* which is actuated when the signal from the circuit 276RF exceeds the signal from the circuit 276LF and a second driver circuit 278*b* which is actuated when the signal from circuit 276RF is less than the signal from circuit 276LF. Similarly, driver circuits 280*a* and 280*b* are connected to voltage comparator circuit 280 and driver circuits 282*a* and 282*b* are connected to voltage comparator circuit 282. Each driver circuit identified by the lower case "a" is actuated when its associated potentiometer signal exceeds that of the master potentiometer 130LF and the driver circuits identified by the lower case "b" are actuated when the associated potentiometer signal is less than that of the master potentiometer 138LF**.

Associated with cylinders 86R, 104R and 104L are valves 86RV, 104RV and 104LV, respectively. Each of the valves 86RV, 104RV and 104LV has a first solenoid 288 connected, respectively, to the driver circuits **278*a*, 280*a*, 282*a* and a second solenoid 290 respectively connected to driver circuits 278*b*, 280*b* and 282*b*. It will, therefore, be appreciated that when the voltage at wiper 140RF exceeds the voltage at wiper 140LF indicating that the right front fork 42RF is ahead of the left front fork 42LF the driver circuit 278*a* will receive a signal to actuate solenoid 288. Conversely, when the voltage on the wiper 140RF is less than the voltage in wiper 140LF indicating that the right front fork is behind the left front fork, driver circuit 278*b* will receive a signal to actuate solenoid 290. The solenoids 288 and 290 of valves 140RV and 140LV** will similarly be actuated if the left rear or right rear forks are ahead of or behind the left front fork.

When solenoid 288 of valve 86RV is actuated, it will connect conduit 292 to conduit 294 thereby providing a return path to the sump from the upper end of cylinder 86R. This will tend to cause the right front fork to move back into annular alignment with the left front fork. On the other hand, should the right front fork fall behind the left front fork, driver circuit **278*b* will be actuated to energize solenoid 290 of valve 86RV. As a result the lower end of cylinder 86R will be connected to sump 64 through conduits 296 and 298. This will tend to increase the rotation of the right front fork and to move the same into alignment with the left front fork. As the right front fork moves into alignment with the left front fork the signal from circuit 278 will cease to de-energize solenoid 288 to return valve 86RV to its neutral position. When the forks are in fact in alignment, the signal to driver circuits 278*a* will cease thereby de-energizing solenoid 290 and opening the shunt path through conduits 296 and 298. The valves 104RV and 104LV** will similarly be actuated should the left rear or right rear forks move out of alignment with the left front fork.

When it is desired to switch the hydraulic system from the four-wheel steering mode to the two-wheel steering mode, each of the wheels are returned to their zero deflection position which will close the photo switches 126. Selector switch 184 may then be closed to complete the energizing circuit to the solenoid 299 through conductors 174, contact 299, conductors 300, 302 and 176. This steps relay contacts 304 from their position shown by full lines to that shown by broken lines in FIG. 9 to energize solenoid 147 of valve 142 through conductors 174, 305, 306, 308 and 176. When solenoid 147 is energized, it operates valve 142 so that pump output conduit 152 is connected to conduit 228 and sump return conduit 158 is connected to conduit 230. In this manner, the upper end of shot pin cylinders 102 and 118 at the lower end of shot pin cylinders 84 are connected to pump 140 and their opposite ends are connected to pump 164. Accordingly, each of the shot pin cylinders 84 are extended to couple the two-wheel steering cylinders 56 to the front forks, shot pin cylinders 102 are retracted to uncouple the four-wheel steering cylinders 86 from the front forks and the shot pin cylinders 118 are extended to couple the rear forks to the rear posts 42. This movement of the shot pin cylinders will open each of the limit switch contacts 246, 248 and 250 and de-energize solenoids 147 so that valves 144 and 145 are returned to a neutral position to prevent the delivery of fluid under pressure to the four-wheel steering cylinders 86 and 104. When each of the shot pin cylinders reaches the end of their travel, the limit switch contacts 178, 180 and 182 are closed as shown in FIG. 7 so that the two-wheel steering cylinders 56 may then be initiated in the manner discussed with respect to FIG. 7.

The closing of the contacts 178, 180 and 182 will also energize relay 310 to step contacts 190 from their position shown in FIG. 8 to their position shown in FIG. 7. As a result relay 299 is de-energized to de-energize solenoid 147 of valve 142 which then returns to the neutral position shown in FIG. 7.

While only a single embodiment of the invention is illustrated and described, it is not intended to be limited thereby but only by the scope of the appended claims.

I claim:

1. A mobile crane having spaced apart first and second front wheel means and spaced apart first and second rear wheel means which are also spaced from said front wheel means, first and second steering means, first and second coupling means for coupling said first and second steering means to said first and second front wheel means, respectively, first and second connecting means each having a first mode for connecting said first and second steering means to a power source for turning said front wheels through a turning angle, third and fourth steering means respectively associated with said first and second front wheel means and fifth and sixth steering means associated with said first and second rear wheels, respectively, third and fourth coupling means for coupling said third and fourth steering means, respectively, to said first and second front wheel means and fifth and sixth coupling means for locking and unlocking said first and second rear wheel means, respectively, in a predetermined orientation, said fifth and sixth steering means are operable to turn the said rear wheel means through a turning angle when the same are unlocked, said first and second connecting means having a second mode wherein said third, fourth, fifth and sixth steering means are coupled to said power source for simultaneously turning said front and rear wheel means through the same turning angles.

2. The mobile crane set forth in claim 1 and including first interlock means for preventing said first and second connecting means from being placed in their first mode unless said first and second coupling means have coupled said first and second steering means to said front wheel means and said third and fourth means have uncoupled said third and fourth steering means therefrom and said fifth and sixth coupling means have locked said rear wheel means in a fixed orientation, and second interlock means for preventing said first and second selectively operable means from being placed in a second mode unless said first and second coupling means have disconnected said first and second steering means from said front wheel means and said third and fourth coupling means have coupled said second and third steering means to said front wheel means and said fifth and sixth coupling means have unlocked said rear wheel means from their fixed orientations.

3. The combination set forth in claim 1 and including first means associated with each wheel means for measuring the turning angle thereof and for producing a signal functionally related thereto, comparison means for comparing the signal functionally related to the turning angle of one wheel means with that associated with each of said other wheel means for generating an error signal when the turning angle of one of said other wheel means differs from that of said one wheel means, and third, fourth and fifth selectively operable means each responsive to a different one of said error signals and being connected to a different one of the steering means associated with said other wheel means for independently adjusting the turning angle of each wheel until they are in correspondence with said one wheel.

4. The mobile crane set forth in claim 1 wherein said first, second, third and fourth coupling means comprise hydraulic cylinder means each operable to move pin means into and out of a pin receiving means for effecting its coupling and uncoupling, and valve means having a first mode for simultaneously actuating said coupling means to couple said first and second steering means to said front wheel means, uncoupling said third and fourth steering means from said rear wheel means and locking said rear wheel means in their fixed orientations, said valve means having a second mode for simultaneously actuating said coupling means to uncouple said first and second steering means from said front wheel means, coupling said third and fourth steering means to said front wheel means and unlocking said rear wheel means from its fixed orientation.

5. The mobile crane set forth in claim 4 and including third interlock means coupled to each said wheel means for preventing said valve means from being placed in either its first or second modes unless each of said wheel means is in a predetermined orientation to permit said pin means to move into and out of said pin receiving means.

6. The combination set forth in claim 1 and including means for actuating each of said coupling means, and enabling means associated with each of said wheel means for enabling said actuating means when each respective wheel is in a predetermined orientation whereby said coupling means cannot be actuated when any of said wheel means are out of said orientation.

7. The mobile crane set forth in claim 1 wherein each of said steering means are hydraulically actuated, said first and second selectively operable means comprise first and second valve means operative when in said first mode to couple said first and second steering means to a source of hydraulic pressure and when in said second mode to couple said third, fourth, fifth and sixth steering means to said source, and control means for stepping said valve means into and out of said modes.

8. The combination set forth in claim 7 and wherein said control means includes means for actuating each of said coupling means, and enabling means associated with each of said wheel means for enabling said actuating means when each respective wheel is in a predetermined orientation whereby said coupling means cannot be actuated when any of said wheel means are out of said orientation.

9. The mobile crane set forth in claim 8 wherein said enabling means includes first interlock means for preventing said first and second valve means from being placed in their first mode unless said first and second coupling means have coupled said first and second steering means to said front wheel means and said third and fourth means have uncoupled said third and fourth steering means therefrom and said fifth and sixth coupling means have locked said rear wheel means in a fixed orientation, and second interlock means for preventing said first and second valve means from being placed in a second mode unless said first and second coupling means have disconnected said first and second steering means from said front wheel means and said third and fourth coupling means have coupled said second and third steering means to said front wheel means and said fifth and sixth unlocked coupling means have said rear wheel means from their fixed orientations.

10. The mobile crane set forth in claim 9 wherein said first, second, third and fourth coupling means comprise hydraulic cylinder means each operable to move pin means into and out of a pin receiving means for effecting its coupling and uncoupling, and additional valve means having a first mode for simultaneously actuating said coupling means to couple said first and second steering means to said front wheel means, uncoupling said third and fourth steering means from said rear wheel means and locking said rear wheel means in their fixed orientations, said additional valve means having a second mode for simultaneously actuating said coupling means to uncouple said first and second steering means from said front wheel means, coupling said third and fourth steering means to said front wheel means and unlocking said rear wheel means from its fixed orientation.

11. The mobile crane set forth in claim 10 and including third interlock means coupled to each said wheel means for preventing said additional valve means from being placed in either its first or second modes unless each of said wheel means is in a predetermined orientation to permit said pin means to move into and out of said pin receiving means.

12. The combination set forth in claim 11 and including first means associated with each wheel means for measuring the turning angle thereof and for producing a signal functionally related thereto, comparison means for comparing the electrical error signals functionally related to the turning angle of one wheel means with that associated with each of said other wheel means for generating an error signal when the turning angle of one of said other wheel means differs from that of said one wheel means, and third, fourth and fifth valve means each responsive to a different one of said error signals and being connected to a different one of the steering means associated with said other wheel means for independently adjusting the turning angle of each wheel until they are in correspondence with said one wheel.

13. The mobile crane set forth in claim 12 wherein said first means comprises servo means connected to each of said wheel means and operative to produce electrical error signals functionally related to any deviation in the turning angle of any three of said wheel means from that of a fourth, and second valve means responsive to said error signals and coupled to the first valve means for adjusting the flow of hydraulic fluid to the hydraulic steering means of said three wheel means in a manner to reduce any such deviation.

14. The mobile crane set forth in claim 13 wherein said servo means comprises potentiometer means mounted on each wheel means for providing a potential signal related to the turning angle of its associated wheel means, and potential comparison means for comparing the potential signal associated with one wheel means with that of each said other wheel means for providing said error signals.

15. The mobile crane set forth in claim 14 wherein said first and second enabling means comprise limit switch means associated with said cylinder means, said control means including electrical circuit means for stepping said first and second valve means between said modes.

16. The mobile crane set forth in claim 15 wherein said third interlock means comprises photo-responsive means operative when said wheel means are in alignment.

17. A mobile crane having spaced apart first and second front wheel means and spaced apart first and second rear wheel means which are also spaced from said front wheel means, first and second steering means, first coupling means for coupling and uncoupling said first and second steering means to said first and second front wheel means, respectively, connecting means having a first mode for connecting said first and second steering means to a power source for turning said front wheels through a turning angle, third and fourth steering means respectively associated with said first and second front wheel means and fifth and sixth steering means coupled to said first and second rear wheels, respectively, second coupling means for coupling said third and fourth steering means, respectively, to said first and second front wheel means, and third coupling means for locking and unlocking said first and second rear wheel means in a predetermined orientation, said connecting means having a second mode wherein said second and third steering means are coupled to said power source for simultaneously turning said front and rear wheel means through the same turning angles.

18. The mobile crane set forth in claim 17 and including first interlock means for preventing said selectively operable means from being placed in their first mode unless said first coupling means have coupled said first and second steering means to said front wheel means and said second coupling means has uncoupled said third and fourth steering means therefrom and said third coupling means have locked said rear wheel means in a fixed orientation, and second interlock means for preventing said connecting means from being placed in a second mode unless said first coupling means has disconnected said first and second steering means from said front wheel means and said second coupling means has coupled said second and third steering means to said front wheel means and said third coupling means have unlocked said rear wheel means from their fixed orientations.

19. The combination set forth in claim 18 and including first means associated with each wheel means for measuring the turning angle thereof and for producing a signal functionally related thereto, comparison means for comparing the electrical signal functionally related to the turning angle of one wheel means with that associated with each of said other wheel means for generating an error signal when the turning angle of one of said other wheel means differs from that of said one wheel means, and second connecting means responsive to said error signals and being connected to said steering means for independently adjusting the turning angle of each wheel until they are in correspondence with said one wheel.

20. A mobile crane having spaced apart first and second front wheel means and spaced apart first and second rear wheel means which are also spaced from said front wheel means, first and second hydraulic steering means respectively associated with said first and second front wheel means, third and fourth hydraulic steering means, respectively associated with said first and second rear wheel means, each said hydraulic steering means being operative to turn its responsive wheel means through turning angles, first selectively operable valve means for connecting each said hydraulic steering means to a source of hydraulic pressure and for delivering proportioned quantities of hydraulic fluids to each, said valve means having a first mode wherein said first and second hydraulic means are coupled to said source of hydraulic pressure for simultaneously turning said front wheel means through the same turning angles.

first and second coupling means for coupling said third and fourth hydraulic steering means to said rear wheel means, respectively, and third and fourth coupling means for selectively locking and unlocking said rear wheel means in a predetermined orientation whereby when said rear wheels are unlocked, said third and fourth hydraulic steering means are operable to turn the same through a turning angle, said valve means having a second mode wherein said first, second, third and fourth hydraulic steering means are coupled to said source of hydraulic pressure for simultaneously turning said front and rear wheel means through the same turning angles, servo means connected to each of said wheel means and operative to produce electrical error signals functionally related to any deviation in the turning angle of any three of said wheel means from that of said fourth, and second valve means responsive to said error signals and coupled to the first valve means for adjusting the flow of hydraulic fluid to the hydraulic steering means of said three wheel means in a manner to reduce any such deviation.

21. The mobile crane set forth in claim 20 wherein said servo means comprises potentiometer means mounted on each wheel means for providing a potential signal related to the turning angle of its associated wheel means, and potential comparison means for comparing the potential signal associated with one wheel means with that of each of said other wheel means for providing said error signals.

22. A mobile crane having spaced apart first and second front wheel means and spaced apart first and second rear wheel means which are also spaced from said front wheel means, first and second steering means, first coupling means for simultaneously coupling said first and second steering means to said first and second front wheel means, respectively, connecting means having a first mode for connecting said first and second steering means to a power source for turning said front wheels through a turning angle, third and fourth steering means respectively associated with said first and second front wheel means and fifth and sixth steering means associated with said first and second rear wheels, respectively, second coupling means for simultaneously coupling said third and fourth steering means to said first and second front wheel means and third coupling means for simultaneously locking and unlocking said first and second rear wheel means in a predetermined orientation, said fifth and sixth steering means are operable to turn the said rear wheel means through a turning angle when the same are unlocked, said connecting means having a second mode wherein said third, fourth, fifth and sixth steering means are coupled to said power source for simultaneously turning said front and rear wheel means through the same turning angles.

23. The mobile crane set forth in claim 22 wherein each of said steering means are hydraulically actuated, said first coupling means comprises first and second valve means operative when in said first mode to couple said first and second steering means to a source of hydraulic pressure and when in said second mode to couple said third, fourth, fifth and sixth steering means to said source, and control means for stepping said valve means into and out of said modes.

24. The combination set forth in claim 23 and wherein said control means includes actuating means for actuating each of said valve means, and enabling means associated with each of said wheel means for enabling said actuating means when each respective wheel is in a predetermined orientation whereby said coupling means cannot be actuated when any of said wheel means are out of said orientation.

25. The mobile crane set forth in claim 24 and including first interlock means for preventing said first connecting means from being placed in its first mode unless said first coupling means has coupled said first and second steering means to said front wheel means and said second coupling means has uncoupled said third and fourth steering means therefrom and said third coupling means has coupled said rear wheel means in a fixed orientation, and second interlock means for preventing said connecting means from being placed in its second mode unless said first coupling means has disconnected said first and second steering means from said front wheel means and said third and fourth coupling means have coupled said second and third steering means to said front wheel means and said fifth and sixth coupling means have uncoupled said rear wheel means from their fixed orientations.

* * * * *